United States Patent [19]

Killion

[11] 4,450,930

[45] May 29, 1984

[54] MICROPHONE WITH STEPPED RESPONSE

[75] Inventor: Mead C. Killion, Elk Grove Village, Ill.

[73] Assignee: Industrial Research Products, Inc., Elk Grove, Ill.

[21] Appl. No.: 414,659

[22] Filed: Sep. 3, 1982

[51] Int. Cl.[3] ..... G10K 13/00; H04R 25/00

[52] U.S. Cl. ..... 181/158; 181/129; 181/130; 181/160; 181/166; 179/107 E; 179/180; 179/181 R; 179/182 R

[58] Field of Search ..... 181/129, 130, 132, 135, 181/158, 160, 166; 179/107 E, 107 FD, 107 S, 107 R, 182 R, 179, 180, 111 E, 114 A

[56] References Cited

U.S. PATENT DOCUMENTS

| | | | |
|---|---|---|---|
| 2,533,516 | 12/1950 | Schwalm | 179/107 R |
| 3,013,127 | 12/1961 | Christensen et al. | 179/180 |
| 3,193,048 | 7/1965 | Kohlen | 181/158 |
| 3,536,861 | 10/1970 | Dunlavy | 179/107 S |
| 3,740,496 | 6/1973 | Carlson et al. | 179/111 E |
| 3,930,560 | 1/1976 | Carlson et al. | 181/160 |
| 4,063,050 | 12/1977 | Carlson et al. | 179/111 E |

*Primary Examiner*—Benjamen R. Fuller

*Attorney, Agent, or Firm*—Wallenstein, Wagner, Hattis, Strampel & Aubel

[57] ABSTRACT

A microphone, particularly for hearing aid application, said microphone providing a stepped response characteristic relative to frequency wherein low frequency sounds will couple to the associated hearing aid with a restricted amount of amplification, while providing an emphasis or higher amplification for the higher frequencies in the bandwidth of interest.

11 Claims, 5 Drawing Figures

MICROPHONE WITH STEPPED RESPONSE

TECHNICAL FIELD

A miniature microphone, particularly for hearing aid application, said microphone having a stepped response characteristic relative to frequency.

BACKGROUND OF THE INVENTION

It is well-known that the hearing loss of people having impaired hearing may not be uniform over the entire audio frequency range, but may be more pronounced in certain frequency ranges. For example, some people with impaired hearing experience a loss of hearing for sounds at the higher audio frequencies, while others experience the loss of hearing for sounds at the lower frequencies.

The present invention is directed toward people who have substantially normal hearing for sound at the lower frequencies (at below approximately 1,000 HZ), but who suffer a substantial hearing loss at the higher audio frequencies (at above approximately 1,000 HZ). The people in this segment of the population find that they receive benefits from hearing aids designed to amplify higher frequencies; however, if such hearing aids also amplify low frequency sounds, these higher amplitude low frequency sounds will annoy the users; see curve "b" of FIG. 4.

In the past, several traditional approaches have been devised, with the aim of solving the foregoing problem. For example, one approach has been to provide amplifiers in the hearing aid which include high pass filter networks to eliminate the signals at low frequency. Also, microphones and receivers are built to contain features to filter out the low frequencies. However, such prior art measures usually result in a continuing decrease in sound transmission as the sound frequency is lowered and a loss of the information contained in this low frequency portion of the sound spectrum; see curve "c" of FIG. 4.

Another approach toward controlling the emphasis provided to different portions of the audio range is the so-called Contralateral Routing of Offside Sound or "CROS" hearing aids. Such hearing aids, which may take several forms, commonly consist of an arrangement that locates a microphone on one side of the head and a means of routing the signal, such as by wire embedded in the eyeglass frame, to a receiver which is located on the opposite side of the head. The sound is led into an ear canal by means of a tube which is sufficiently smaller than the ear canal so as not to block the normal entry of sound. In this latter ear, the unamplified sound enters through the passage outside of the tube, while the higher frequency sounds are augmented by the hearing aid. An example of a CROS hearing aid system is shown in U.S. Pat. No. 3,536,861 to Dunlavy.

However, a problem with such CROS schemes is that the sound emitted from the tube can find its way back to the microphone to cause undesirable oscillations and feedback to the microphone.

Another approach to the foregoing problem is shown in U.S. Pat. No. 3,193,048, wherein different combinations of tubes and vents which connect to an acoustic chamber on the backside of the microphone may be opened and closed to provide improved low frequency response. However, even with the various combinations disclosed in this patent, the response curves drop sharply at the lower audio frequencies.

Still another prior art approach for providing an improved low frequency response characteristic is shown in U.S. Pat. No. 3,013,127, wherein the sound to the microphone diaphragm is substantially divided and coupled through separate sound ducts, one duct being relatively long and constricting, to provide sound inlets to both sides of the diaphragm. However, the structure of U.S. Pat. No. 3,013,127 provides undesirable response peaks and undesirable attenuation, and provides a response which drops sharply at the lower frequencies.

SUMMARY OF THE INVENTION

The present invention comprises a microphone which provides frequency-shaping construction such that the sounds at lower frequencies will be passed through an associated hearing aid with a restricted amount of amplification, while the sounds at higher frequencies will obtain 15 to 30 dB higher amplification.

BRIEF DESCRIPTION OF SEVERAL VIEWS OF DRAWINGS

The foregoing features and advantages of the present invention will be apparent from the following more particular description of the invention. The accompanying drawings, listed hereinbelow, are useful in explaining the invention wherein.

DETAILED DESCRIPTION

The structural details of one embodiment of the invention will first be described; then some theoretical concepts relative thereto will be explained.

Basically, the inventive microphone contains a new type of frequency shaping structure so that, when it is applied to a conventional hearing aid using a sealed earmold, the low frequency sounds will be passed through the hearing aid with a restricted amount of amplification, while providing emphasis for the high frequencies. The earmold for the assocated hearing aid markedly reduces feedback problems.

Figure 1:
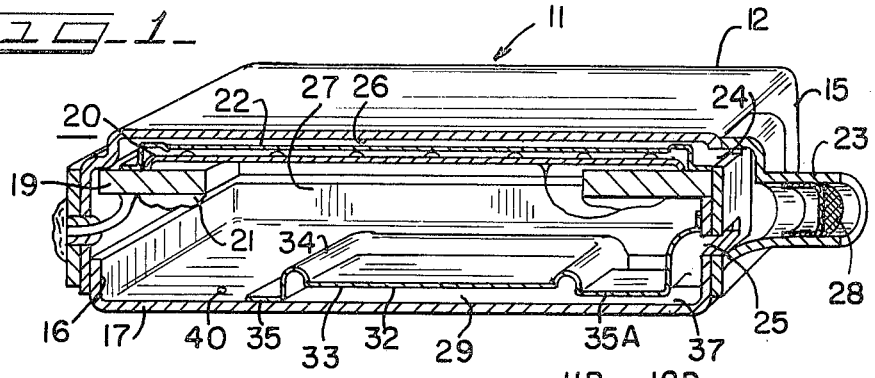
FIG. 1 is one embodiment of a microphone in accordance with the invention.

In FIG. 1, the transducer 11 of the invention functions as a microphone and comprises a case or housing 12 which, in one embodiment, is rectangular in shape and has depending walls 15. A mating closure plate 17, which comprises a generally flat plate with upstanding walls 16, is affixed to walls 15 to close the case 12. Walls 15 have a shoulder 18 formed thereon for positioning a non-conductive bulkhead 19 which, in turn, supports an electret diaphragm assembly 20 and the associated electronic amplifier circuitry 21.

The electronic circuitry 21 may be of the type described in U.S. Pat. No. 4,063,050, filed in the names of E. V. Carlson and M. C. Killion, entitled "Acoustic Transducer with Improved Electret Assembly", and assigned to the same Assignee as the present invention, and specifically incorporated herein by reference.

The electret diaphragm assembly 20, including its diaphragm 22, may generally be of the type described in U.S. Pat. No. 3,740,496, entitled "Diaphragm Assembly for Electret Transducer", in the names of E. V. Carlson and M. C. Killion, and assigned to the same Assignee as the present invention, which patent is specifically incorporated herein by reference.

A suitable acoustical signal input tube 23 is mounted on case 12, such as by cementing thereto, and communicates with the acoustical openings or ports 24 and 25 formed in end wall 15 to couple sound to the interior of case 12; and, more particularly, to couple sound to acoustic cavities or chambers 26 and 27, respectively, as will be explained.

A damping element 28 may be positioned in tube 23. One damping element which may be used is of the type described and claimed in U.S. Pat. No. 3,930,560, filed in the names of E. V. Carlson and A. F. Mostardo, Jr., titled "Damping Element", and assigned to the same Assignee as the present invention, and incorporated herein by reference.

Also, a very small vent 40 may be provided in diaphragm 22 to allow the pressure in the cavity behind the diaphragm to equalize the changes in the ambient pressure. The size of this vent 40 can be selected to provide additional attenuation at very low frequencies.

Importantly, the inventive microphone 11 includes a second diaphragm or resilient movable member 32. In the embodiment of FIG. 1, diaphragm 32 may be somewhat similar to, but may be smaller than, diaphragm 21. Diaphragm 32 includes a central plate-like portion 33 and a raised flexible surround 34 formed on the periphery of the central portion 34. The surround includes a horizontally extending support flange 35, which is affixed to the inside surface of the closure plate 17 to form an acoustic chamber or cavity 29. A section 35A of the support flange 35 opens an acoustical path or passage 37 to cavity 29 from sound port 25.

Thus, as described above, the inventive microphone 11 includes a first acoustical chamber or cavity 26 formed on the front side of the diaphragm 22 between the top of the case 12 and the diaphragm; a second acoustical chamber or cavity 27 formed on the other, or back, side of the diaphragm 22; and a third acoustical chamber or cavity 29 formed between the second diaphragm 32 and the bottom plate 17, which closes the bottom of the case 12.

Accordingly, microphone 11 provides an additional sound path which, at certain frequencies, tends to balance or equalize the sound pressure between the front and back of the diaphragm to provide the desired stepped response characteristic, as will be explained.

Figure 3:
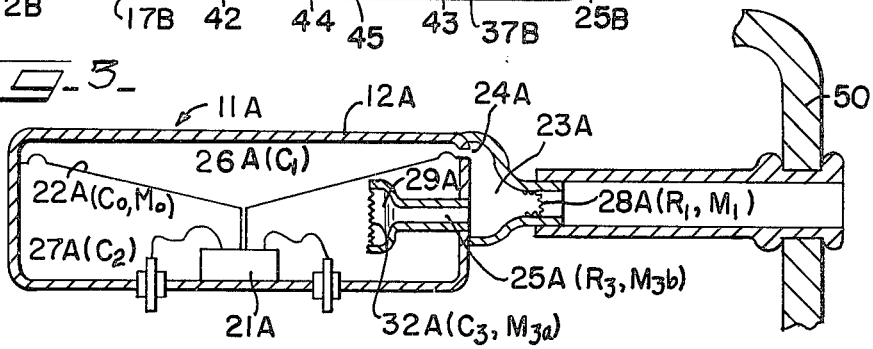
FIG. 3 is a sketch of a microphone in accordance with the invention, and is useful in explaining certain theoretical considerations.

The theoretical concept of the invention is illustrated schematically in FIG. 3, which describes a microphone 11A mounted in a hearing aid housing 50. (In FIG. 3, the elements are numbered to correspond as closely as possible to the similarly numbered elements in FIG. 1 and have the included suffix or label "A".) A diaphragm 22A separates the microphone case 12A into two acoustic chambers or cavities 26A and 27A. Cavity 26A is formed on the front side of the diaphragm 22A; and cavity 27A is formed on the back side of the diaphragm.

An electroacoustic transducer 21A is mounted in cavity 27A of the microphone 11. A common sound duct 23A couples sound to cavity 26A through a main sound port 24A. A damping element or filter 28A, positioned in the common duct 23A, provides an inertance and resistance to the incoming sound. Sound pressure is also coupled from common duct 23A through a second sound duct or channel 25A to a third sound cavity or chamber 29A formed within cavity 27A. Cavity 29A is formed at the end of channel 25A; and the cavity is closed by a second diaphragm 32A. The second diaphragm 32A is movable and effective in sound cavity 27A. Cavity 29A distributes the sound across the surface of the second diaphragm 32A, which provides a compliance for the controlled division of sound pressure at the lower frequency.

Figure 4:
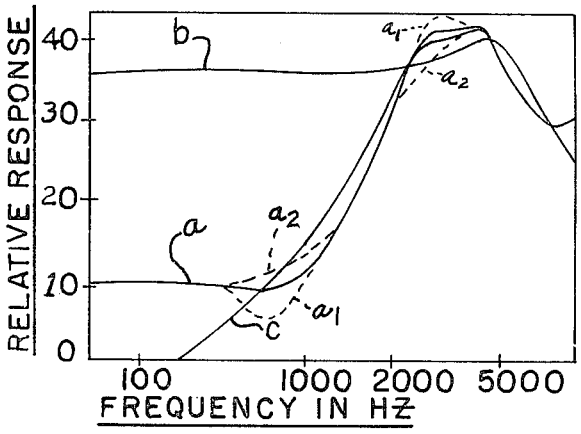
FIG. 4 is a frequency response curve, useful in explaining the operation of the invention.
Figure 5:
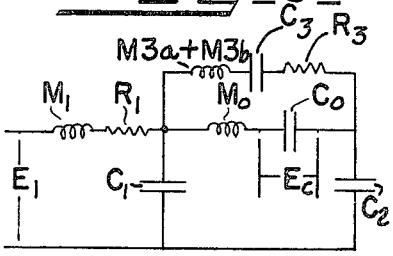
FIG. 5 is an analog representation of the sketch of FIG. 3.

Refer also now to the analog electrical circuit of FIG. 5. (Note that, in FIG. 5, the electrical elements in the circuit are labeled to relate to the structural elements of FIG. 3.) At low and moderate frequencies, the signal will be passed through inductance $M_1$ and resistance $R_1$ to cavity $C_1$ without attentuation. The added signal path will consist of an acoustic inertance $M_{3a}$ and $M_{3b}$, acoustic resistance $R_3$, and an acoustic compliance $C_3$. The acoustic inertance and resistance function approximately as above. However, in this construction, at low frequencies, the pressure becomes equalized across the combination of the compliance of the diaphragm $C_3$ and $C_0$, in series with the cavity $C_2$, which is behind the diaphragm of the microphone. This limits the amount of pressure equalization that can occur in the cavity $C_2$ behind the diaphragm and, thus, puts a limit on how much the low frequency response will be attentuated approximately 30 dB; see curve "a" in FIG. 4. The inertances $M_{3a}$ and $M_{3b}$ are chosen so as to control the frequency at which the transition between normal sensitivity and reduced sensitivity occur. By properly choosing the value of the resistance $R_3$, the damping of the resonances can be adjusted to provide an approximation to a step in the response shape. The dotted line portion $a_1$ of curve a in FIG. 4 illustrates the effect of too little resistance; and dotted line portion $a_2$ illustrates the effect of too high a resistance. For example, a more restricted cross-section of the sound duct 25A increases the amount of resistance with respect to the amount of inertance; and the total magnitude of the impedance is adjusted by varying the length of the duct 25A.

Figure 2:
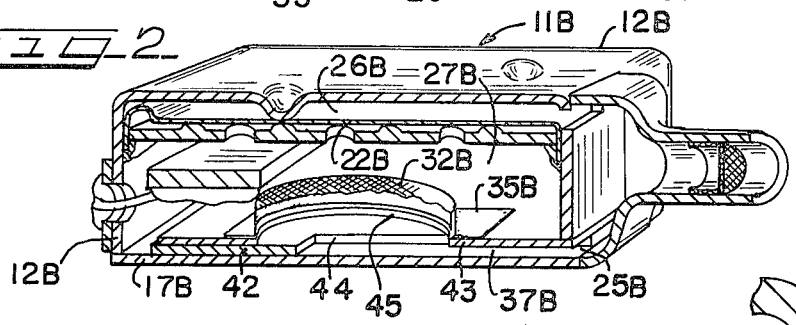
FIG. 2 is a second embodiment of a structure in accordance with the present invention.

The structure of the second embodiment of the invention, as shown in FIG. 2, is substantially similar to the structure of FIG. 1, but includes various changes in the interior mounting arrangements, as disclosed and claimed in the aforementioned U.S. Pat. No. 4,063,050.

Microphone 11B in FIG. 2 is generally similar to microphone 11 of FIG. 1. Microphone 11B particularly shows a simplified means for forming the passage or channel 37B for conveying the sound from sound port 25B to the second diaphragm 32B, as will be explained.

Note that diaphragm 22B separates the case 12 into two acoustic chambers or cavities 26B and 27B, similarly as in the structure of FIG. 1. In this embodiment, the second diaphragm 32B is circular in plan view, and has a relatively matrix patterned, or wrinkled, upper surface and an outwardly extending flange 35B. Note, of course, that the particular configuration or size of the diaphragms 32 and 32B, as shown in FIGS. 1 and 2, are not to be considered limiting in any aspect.

The passage 37B is formed by providing a first plate 42 having a channel or slot 44 formed therein, with the slot extending from approximately the center of the plate to the edge of the plate, and by a second plate 43 having a relatively large circular aperture 45 at its center, over which is mounted the diaphragm 32B as by cementing its flange 35B to plate 43. The plates 42 and 43 are mounted in stacked position in case 12. The channel 44 in plate 43 has its free or open end opening to port 25B, which permits sound to pass through the channel 44, and thence up through aperture 45 in plate 43 to impinge on the second diaphragm 32B.

The inventive structural configuration of the microphone of FIGS. 1 and 2 functions in the manner described above with reference to the sketch of FIG. 3 and the circuit of FIG. 5 to provide a stepped frequency response characteristic, wherein the low frequency sounds will be passed through the associated hearing aid with a controlled and limited amount of amplification, while providing emphasis for the high frequencies.

In summary, in both of the embodiments of FIGS. 1 and 2, sound is channeled to the microphone through a sound duct. At the end of the duct, there are separate apertures to the interior of the microphone, a first aperture leading to the front surface of the diaphragm and a second aperture leading through a channel to a small cavity that is provided to distribute the sound across the surface of an added diaphragm. The purpose of this added diaphragm is to provide the compliance necessary for the controlled pressure division at low frequency. The mass of the air in the channel and the mass of the added diaphragm together provide the inertance necessary to determine the frequency at which the transitions take place. The dimensions of the channel are chosen to provide the proper amount of acoustic impedance. The magnitude, as well as the relative value, of the various parameters are adjusted through selection of area and shape of the cross-section and the length of the channel.

As mentioned above, the inventive microphone has particular application when utilized with a hearing aid using a sealed or nearly sealed earmold. The low frequency sounds will pass through the hearing aid with little amplification, while providing emphasis for the high frequencies; that is, the inventive microphone provides a stepped response characteristic. Since the earmold seals or nearly seals the ear, the amount of emphasis of the higher frequencies is not limited, such as due to unwanted oscillations or feedback problems; and, thus, the inventive microphone provides a more useful hearing aid system.

While the invention has been particularly shown and described with reference to a preferred embodiment thereof, it will be understood by those skilled in the art that various changes in form and details may be made therein without departing from the spirit and scope of the invention.

I claim:

1. A microphone providing a stepped frequency response characteristic comprising: a case; a diaphragm mounted in said case to form first and second separate sound cavities therein; port means in said case for coupling external sound to said first cavity; a sound pressure responsive member positioned to define an acoustic chamber within said second sound cavity and for providing a compliance to sound couple thereto; and a sound passage coupling to said port means for coupling external sound to said acoustic chamber, said sound passage having selected dimensions for providing a resistance and inertance to the passage of sound, and said sound pressure responsive member providing a compliance and inertance whereby a selected pressure equalization is obtained in said second cavity to limit the attentuation of sounds at the lower frequencies while enabling the microphone to provide emphasis for sound at the higher frequencies.

2. A microphone as in claim 1, wherein said sound pressure responsive member comprises a second diaphragm positioned in said case to form the acoustic chamber.

3. A microphone comprising: a casing; acoustic transducing means, including a diaphragm in said casing; sound cavities formed on opposite sides of said diaphragm; sound port means for coupling sound to said cavities; means for controlling the ratio of the pressure of the sound in said cavities on opposite sides of the diaphragm at the lower frequencies and thus limiting the attenuation of the lower frequencies; and means providing an elongated passageway to at least one of said cavities, which passageway has a selected resistance to sound to thereby adjust the damping of the resonances to provide an approximation to a step in the response characteristic.

4. A microphone as in claim 3, wherein the means for controlling the ratio of the pressure is effective to partially equalize the pressure.

5. A microphone as in claim 3, wherein said sound port means includes a sound passage comprising at least two plate members, a first of said plates including a slot formed therein, one end of said slot providing sound coupling to said port means, a second plate including a central aperture therein, a flexible member positioned in one of said cavities and over said aperture, said plates being positioned in a stacked relation, with the aperture positioned over a portion of said slot to form said passage, whereby sound passes through said slot in said second plate to said aperture to influence said flexible member.

6. A microphone as in claim 3, further including sound ducts comprising inertance-providing means for coupling sound to said cavities for controlling the frequency point at which the transition between the higher amplification range and the lower level of amplification occurs.

7. A microphone as in claim 1, wherein said pressure responsive means comprises a diaphragm positioned in said second cavity and adjacent the wall of said case to form a substantially enclosed acoustic chamber, whereby said diaphragm is responsive to sound coupled through said sound passage.

8. A microphone as in claim 1, wherein said microphone is mounted in a housing.

9. A microphone case in claim 1, wherein said sound passage comprises duct means selectable in length and cross-section to control the inertance and resistance provided to sound coupled therethrough.

10. A microphone as in claim 1, wherein the sound pressure responsive member is selected to provide a selected compliance to determine the limit of the attenuation.

11. A microphone as in claim 1, further including a small opening for venting the acoustic chamber to the ambient to provide additional attenuation of very low frequencies.

* * * * *